US005184481A

United States Patent [19]

Joseph et al.

[11] Patent Number: 5,184,481

[45] Date of Patent: Feb. 9, 1993

[54] HOOP JEWELRY HAVING ORNAMENTAL MEMBER SUSPENDED WITHIN THE HOOP, AND METHOD OF MAKING SAME

[75] Inventors: Lawrence Joseph, Boca Raton, Fla.; Frank C. Fuoroli, Coventry, R.I.

[73] Assignee: Jewelry Corporation of America, Inc., Boca Raton, Fla.

[21] Appl. No.: 903,161

[22] Filed: Jun. 24, 1992

[51] Int. Cl.[5] ..... A44C 7/00

[52] U.S. Cl. ..... 63/12; 63/13; 63/2; D11/40; D11/53; D11/76

[58] Field of Search ..... 63/1.1, 2, 12, 13, 18, 63/20, 21, 23; 446/328, 322, 323; D11/40–44, 52–58, 76, 79–83

[56] References Cited

U.S. PATENT DOCUMENTS

| | | | |
|---|---|---|---|
| 483,087 | 9/1892 | Thomas | 446/323 |
| 1,360,470 | 11/1920 | Swityk | 446/322 |
| 3,992,901 | 11/1976 | Parente | 63/2 |
| 4,028,908 | 6/1977 | Michael | 63/23 |
| 4,406,296 | 9/1983 | Wexler | 63/2 |
| 5,094,090 | 3/1992 | Bone | 63/20 |

FOREIGN PATENT DOCUMENTS

| | | | |
|---|---|---|---|
| 689745 | 2/1930 | France | 63/2 |

OTHER PUBLICATIONS

Tag Creations "Tag" Oct. 1971.

*Primary Examiner*—Renee S. Luebke
*Assistant Examiner*—Flemming Saether
*Attorney, Agent, or Firm*—Salter, Michaelson & Benson

[57] ABSTRACT

A novelty jewelry article and method of making same includes a swinging ornament which is suspended within a hoop. The hoop is hollow and has a seam along the inside edge thereof. A pair of holes are drilled along the seam a predetermined distance from each open end of the hoop. The seam above the holes is spread apart. A monofilament having metallic balls crimped to opposing ends thereof is assembled with the hoop wherein the balls are inserted into the open ends of the hoop until the filament reaches the drilled holes and stretches tautly across the hoop. The balls are then glued in place and end castings, one of which may include an earring post, are applied to the open ends of the hoop. An ornament is then secured to the monofilament where it may swing back and forth.

13 Claims, 1 Drawing Sheet

HOOP JEWELRY HAVING ORNAMENTAL MEMBER SUSPENDED WITHIN THE HOOP, AND METHOD OF MAKING SAME

BACKGROUND OF THE INVENTION

The instant invention relates generally to the jewelry art and more specifically to a novelty hoop earring.

Heretofore, hoop earrings have been well known in the jewelry art. In this regard, the U.S. Pat. Nos. 241,381 to Krementz; 245,297 to Heckman; 271,084 to Krementz; 1,208,663 to Rueckert and 4,056,951 to Black disclose various jewelry constructions which have been known in the prior art. The U.S. Pat. No. 241,381 to Krementz discloses a fastener construction for a hoop earring, comprising an ear wire which is attached to a forked spring. The forked spring is adapted to slide within a bent tube. The U.S. Pat. No. 245,297 to Heckman also discloses a fastener construction for a hoop earring comprising a hinged ear wire which locks into a side portion of the hoop. The U.S. Pat. No. 271,084 to Krementz discloses yet another fastener construction for a hoop earring comprising a spring mounted within the hollow tube of the hoop. The spring normally biases the ear wire to a closed position. The U.S. Pat. No. 1,208,663 to Rueckert discloses a fastener construction for a circular key ring. Springs mounted in the closely spaced ends of the key ring body bias spherical end members toward each other thereby closing the gap between the ends of the body. The U.S. Pat. No. 4,056,951 to Black discloses a hoop earring construction including a chamber which is adapted to hold a perfuming agent therein. The chamber includes a plurality of apertures which allow the perfume to escape from the chamber into the ambient air. In one embodiment, the chamber comprises a telescoping tube which extends across the hoop.

SUMMARY OF THE INVENTION

The instant invention provides a novelty hoop earring construction.

Briefly, the earring construction comprises a hoop and a decorative ornament suspended within the hoop. A hollow hoop has a seam along the inside edge thereof and opposing open ends which are disposed in closely spaced relation. A hole is drilled along the seam at a predetermined distance from each open end of the hoop. The seam portion above the holes is then spread apart. A thin filament having a pair of metallic balls crimped at opposing ends thereof is assembled with the hoop wherein the balls are inserted into opposing open ends of the hoop so that the filament passes through the spread-apart seam portions and comes to rest in the drilled holes. At this point the balls can go no further and the filament stretches tautly across the hoop. The balls are then glued in place, and end castings are mounted in the open ends of the hoop. One of the end castings includes an earring post which is adapted to extend through a pierced ear. The end castings can be formed in any desired fashion in order to incorporate the hoop construction into other types of jewelry, such as a pendant for a necklace. An ornament is then secured to the filament so that it is suspended within the hoop. The ornament includes an upwardly extending lug that is notched at the terminal end thereof to receive the filament therein. The notched portion of the lug is then crimped to secure the ornament to the filament. The arrangement is such that the ornament may swing back and forth within the hoop, thus providing an amusing, appealing and unique article of jewelry.

Accordingly, it is an object of the instant invention to provide a novelty jewelry construction.

It is another object to provide a novelty hoop earring.

It is yet another object of the instant invention to provide a hoop earring construction in which a swinging ornament is suspended within the hoop of the earring.

It is still another object of the invention to provide a hoop earring construction in which an ornament is mounted on a thin wire or filament that extends across the hoop.

It is a further object of the instant invention to provide a method of mounting a swinging ornament within a hoop.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
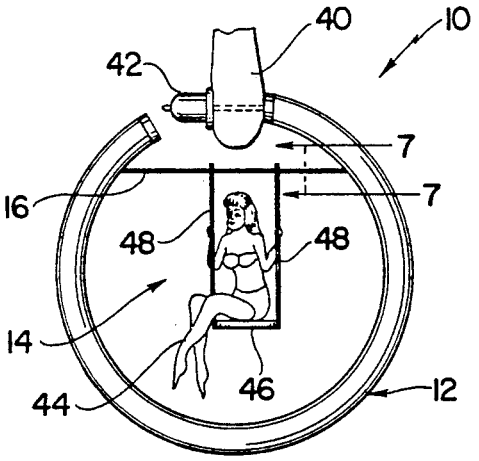
FIG. 1 is a front elevational view of an earring construction embodying the instant invention.
Figure 2:
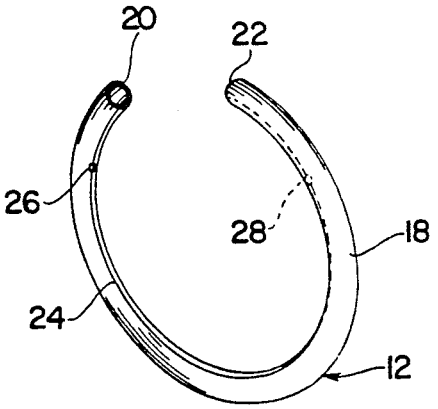
FIG. 2 is a perspective view of the hoop which forms a part of my invention, with the inner seam of the tubular hoop exposed and a pair of opposed holes drilled along the seams.
Figure 3:
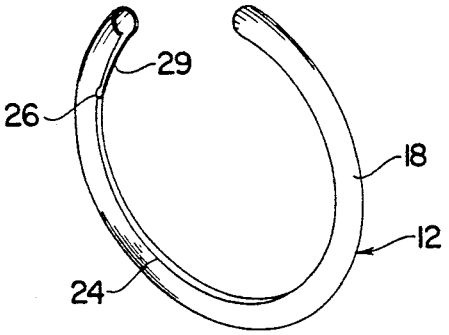
FIG. 3 is a view similar to FIG. 2, with the seam portions above the holes spread apart.
Figure 4:
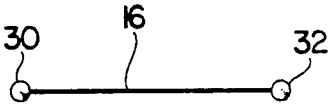
FIG. 4 is an elevational view of the monofilament and ball assembly which forms a part of my invention.
Figure 5:
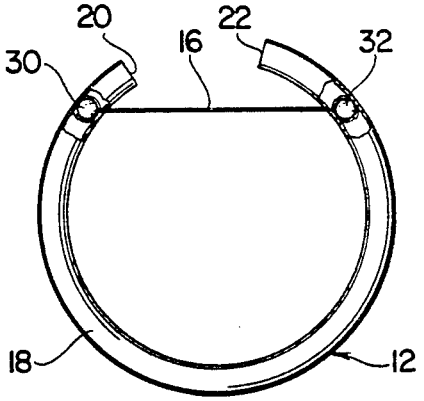
FIG. 5 is another front elevational view of the jewelry construction, partially in section, with the filament assembled in the hoop.
Figure 6:
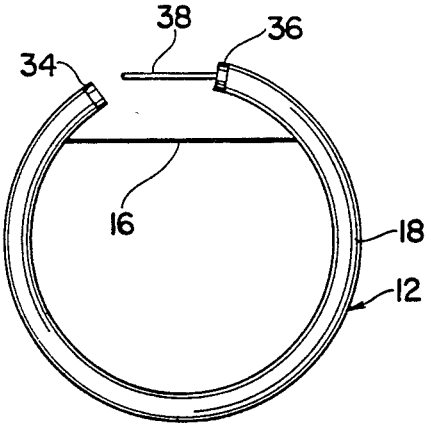
FIG. 6 is another view thereof with end castings mounted on the hoop.

Referring now to the drawings, the instant invention, as utilized in connection with a hoop earring, is illustrated and generally indicated at 10 in FIG. 1. The earring construction 10 comprises a hoop generally indicated at 12 and a decorative ornament generally indicated at 14. The ornament 14 is suspended on a thin filament 16 which extends across the interior portion of the hoop 12. Referring now to FIGS. 2 and 3, it Will be seen that the hoop 12 comprises a hollow tubular body 18 having first and second open ends, 20 and 22, respectively, and a longitudinal seam 24 along the inner peripheral edge thereof. A pair of holes, 26 and 28 respectively, are formed by any suitable means, such as by drilling, at a predetermined distance from the open ends of the hoop (FIG. 2). Illustrated in FIG. 3, it can be seen that the portions of the seam 29 located above the holes 26 and 28 are then spread apart to facilitate assembly of the filament 16 with the hoop 12. In FIG. 4, the filament 16 is illustrated before assembly with the hoop and it comprises a thin wire or monofilament having a pair of metallic balls, 30 and 32 respectively, which are crimped to the filament 14 at opposite ends thereof. The balls 30 and 32 are formed from any suitable metallic material, so that they may be easily crimped to the filament. The filament and ball assembly is then assembled with the hoop 12 (FIG. 5), wherein one of the metal balls 30 is inserted into one open end 20 of the hoop 12 and the other metal ball 32 is inserted into the other open end 22. It is to be understood that the filament 16 slides downwardly through the spread-apart portions 29 of the seam until the filament 16 rests in the holes 26 and 28, and can go no further. At this point the filament 16 will stretch tautly across the width of the hoop. Using a suitable long-nose tool, a drop of adhesive is applied to each of the balls 30 and 32 to secure them in the hoop 12. Since the balls 30 and 32 are secured in their proper position in the hoop 12 it is not necessary to crimp together the spread apart seam portions of the hoop, although this may be done if desired. A pair of small end castings or caps 34 and 36 are then mounted in the open ends of the hoop 12. In the instant embodiment, one of the end castings 36 includes an earring post 38 which is adapted to extend through a pierced ear 40. A backing or clutch member 42 is provided for maintaining the earring in position on the pierced ear 40 (FIG. 1) as is well known in the art. Alternatively, the end castings may be fashioned in other forms so as to enable the hoop construction to be incorporated into other types of jewelry, such as a pendant for a charm bracelet or a necklace.

Figure 7:
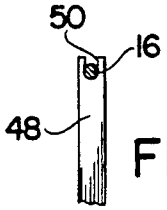
FIG. 7 is a section taken on line 7—7 of FIG. 1.
Figure 8:
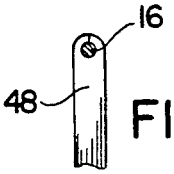
FIG. 8 is a similar view thereof with the lug crimped around the monofilament.

Referring now to FIGS. 1, 7 and 8, the ornament 14 is secured to the filament 16 so that it is suspended within the hoop 12. In the instant embodiment, the ornament comprises a woman 44 sitting on a swing bar 46. It is contemplated that different fanciful ornaments, such as animals or other objects, will also be used in the invention. The ornament 14, whatever it may be, includes at least one upwardly extending lug 48 which is secured to the filament 16. The lug 48 includes a notch 50 at the upper terminal end thereof to receive therein the filament 16. The notch portion 50 is crimped to tightly secure the ornament 14 to the filament 16 so that it does not slide or shift laterally therealong. However, the flexibility of the filament 16 enables the ornament 14 to swing back and forth, it being understood that the lug 48 does not actually pivot with respect to the filament, but rather the swinging action results from twisting or torsion of the filament 16.

It is seen therefore, that the instant invention provides a novelty jewelry construction which is adaptable to be incorporated into many types of jewelry. The instant embodiment of the invention is illustrated as an earring construction which takes the form of a hoop earring having a fanciful ornament suspended within the hoop. The method of constructing the hoop and ornament allows for simple, quick and inexpensive fabrication. The flexible monofilament also allows for a unique swinging action of the ornament, thereby adding greatly to the appeal of the product. For these reasons it is believed that the construction of the instant invention and the method of making same, represents a significant advancement in the jewelry art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An article of jewelry comprising:

a generally circular hoop member;

a thin filament which extends across the hoop member; and a decorative ornament secured to said filament so that the ornament is suspended within said hoop member; said hoop member having first and second ends which are disposed in closely spaced relation; said hoop member comprising a hollow tube having a seam along the inside peripheral edge thereof, said first and second ends being open, said hoop member further having a pair of holes formed along said seam at predetermined distances from said open ends, said seam being spread apart above said holes, said filament including a pair of balls crimped at opposing ends thereof, said filament being assembled with said hollow hoop such that one of said balls is located in one of said open ends and the other ball is located in the other open end, said filament resting in said holes and stretching tautly across said hoop, said balls being secured within said hoop member.

2. In the jewelry article of claim 1, said decorative ornament including an upwardly extending lug, said lug being secured to said filament.

3. In the jewelry article of claim 2, said lug including a terminal end, said end including a notch for receiving therein said filament, said notch being crimped to secure said ornament to said filament.

4. The article of jewelry of claim 1 further comprising an earring post joined to one of said ends.

5. The jewelry article of claim 1 further including a pair of end caps mounted in said open ends.

6. In the jewelry article of claim 5, one of said caps including an earring post which is adapted to extend through a pierced ear.

7. A method of constructing an article of jewelry comprising the steps of:

providing a hollow tubular hoop having spaced first and second open ends and a seam along the inner peripheral edge thereof;

forming a pair of holes along said seam at predetermined distances from each open end of said hoop;

spreading apart the seam above the holes;

providing a thin filament having a pair of balls crimped at the opposing ends thereof;

assembling said filament with said hoop wherein said balls are inserted into the open ends of said hoop and moved downwardly until the filament rests within said holes and stretches tautly across said hoop;

securing said balls within said hollow hoop;

securing a pair of end caps into the open ends of said hoop; and securing a decorative ornament to said filament so as to suspend therefrom within said hoop.

8. The method of claim 7 further comprising the step of joining an earring post to one of said end caps.

9. In the method of claim 7, said ornament including an upwardly extending lug having a terminal end, said method further comprising the step of securing the terminal end of said lug to said filament.

10. In the method of claim 9, said lug including a notch at the terminal end thereof, said method further comprising the steps of locating said filament in said notch and tightly crimping said notch around said filament.

11. An article of jewelry comprising:

a generally circular hoop member;

a thin filament secured to diametrically opposed portions of said hoop member and extending tautly thereacross; and a decorative ornament secured to and suspended from said filament whereby said ornament is restrained against lateral movement along said filament, and whereby twisting of the filament results in back and forth swinging movement of said ornament within said hoop member.

12. In the jewelry article of claim 11, said decorative ornament including an upwardly extending lug tightly secured to said filament, whereby the entire decorative ornament, with the exception of said lug, is located below said filament.

13. In the jewelry article of claim 12, said hoop member having first and second ends which are disposed in closely spaced relation; and an earring post joined to one of said ends.

* * * * *